United States Patent [19]

Gunning et al.

[11] Patent Number: 5,066,837

[45] Date of Patent: Nov. 19, 1991

[54] GAS DAMPED DECELERATION SWITCH

[75] Inventors: Kevin J. Gunning, Tokyo, Japan; David F. Gallup, San Dimas; Lon E. Bell, Pasadena, both of Calif.

[73] Assignee: TRW Technar Inc., Irwindale, Calif.

[21] Appl. No.: 664,499

[22] Filed: Mar. 5, 1991

Related U.S. Application Data

[63] Continuation of Ser. No. 491,110, Mar. 9, 1990, abandoned.

[51] Int. Cl.[5] ..... H01H 35/14

[52] U.S. Cl. ..... 200/61.45 R; 200/61.53; 200/83 R

[58] Field of Search ..... 200/61.45 R, 61.53, 200/83 R, 83 S, 83 B

[56] References Cited

U.S. PATENT DOCUMENTS

| | | | |
|---|---|---|---|
| 3,368,044 | 2/1968 | Green et al. | 200/61.45 R |
| 4,536,629 | 8/1985 | Diller | 200/61.45 R |
| 4,885,439 | 12/1989 | Otsubo | 200/61.45 R |
| 4,929,805 | 5/1990 | Otsubo | 200/61.53 X |

*Primary Examiner*—J. R. Scott

*Attorney, Agent, or Firm*—Tarolli, Sundheim & Covell

[57] ABSTRACT

A damping disk assembly for a gas damped deceleration switch forms part of a means for generating a vacuum to damp movement of a mass which is movable in response to deceleration. The damping disk assembly comprises a rigid damping disk, and a coaxial flexible damping disk with a diameter greater than the diameter of the rigid damping disk. The flexible damping disk comprises a flexible spring disk and a flexible sealing disk, and has an unflexed position in overlaying surface contact with the rigid damping disk.

52 Claims, 9 Drawing Sheets

GAS DAMPED DECELERATION SWITCH

This is a continuation of application Ser. No. 491,110 filed on Mar. 9, 1990, now abandoned.

FIELD OF THE INVENTION

The present invention relates to a gas damped deceleration switch which responds to deceleration of a vehicle to activate a vehicle occupant safety device such as an inflatable airbag.

BACKGROUND OF THE INVENTION

Gas damped deceleration switches which close an electrical circuit to activate an airbag inflator in a vehicle in response to vehicle deceleration are known. One such gas damped deceleration switch is shown in U.S. Pat. No. 4,536,629 wherein a mass is supported in a housing for movement in response to vehicle deceleration. The mass is spring biased into a rest position, and is movable against the bias of the spring toward an electrical contact. The electrical contact is movable by the mass to close an electrical circuit to energize an airbag inflator.

The mass is a rod-shaped member. A rigid, movable damping member is carried on the mass for movement with the mass. A flexible, stationary damping member is fixed to the housing. Movement of the mass from its rest position toward the electrical contact is resisted by damping forces exerted against the movable damping member. When in the rest position, the movable damping member is held in engagement with the stationary damping member to define an air space between the two damping members. As the movable damping member is carried by the mass away from the stationary damping member, the space between the two damping members is enlarged. Enlargement of the space between the two damping members creates a vacuum within the space. The vacuum results in a pressure differential acting across the movable damping member. This pressure differential results in a damping force acting against the movable damping member which resists movement of the mass toward the electrical contact.

If the deceleration is of sufficient magnitude and duration, the mass will be moved against the damping force, as well as against the bias of the spring, to carry the movable damping member away from the stationary flexible member and to open the space between the two members. Thus, the vacuum in the space will no longer exist. Further movement of the mass and the movable damping member is resisted by the continuing bias of the spring and a minimal amount of damping force as required to displace the air around the damping member. If the deceleration is not of sufficient magnitude and duration to cause the moving mass to overcome the damping forces, the mass and the movable damping member will be moved back into their rest position by the bias of the spring.

SUMMARY OF THE INVENTION

In accordance with the present invention, a deceleration switch comprises a housing, a mass movable in the housing in response to deceleration, and means for defining a chamber in which a vacuum is generated as the mass moves. The vacuum damps movement of the mass. The means for defining a chamber comprises a base assembly and a flexible damping disk assembly. The flexible damping disk assembly comprises a flexible sealing disk which sealingly engages the base assembly to define the chamber. The flexible damping disk assembly also includes a flexible spring disk which biases the flexible sealing disk into sealing engagement with the base. The flexible damping disk assembly is supported for movement relative to the base assembly in response to movement of the mass to enlarge the chamber so as to create the vacuum as the mass moves.

In accordance with another aspect of the present invention, a damping disk assembly for damping movement of a movable mass of a deceleration switch comprises a rigid damping disk and a flexible damping disk. The rigid damping disk has an axis and a first diameter, and the flexible damping disk has an axis and a second diameter greater than the first diameter. The flexible damping disk is supportable in an unflexed position in coaxial overlaying contact with the rigid damping disk. The damping disk assembly is connected to the mass for movement in response to movement of the mass.

BRIEF DESCRIPTION OF THE DRAWINGS

The foregoing and other features of the present invention will become apparent to those skilled in the art to which the invention relates upon reading the following description of preferred embodiments of the invention in view of the accompanying drawings, wherein.

DESCRIPTION OF PREFERRED EMBODIMENT

Figure 1:
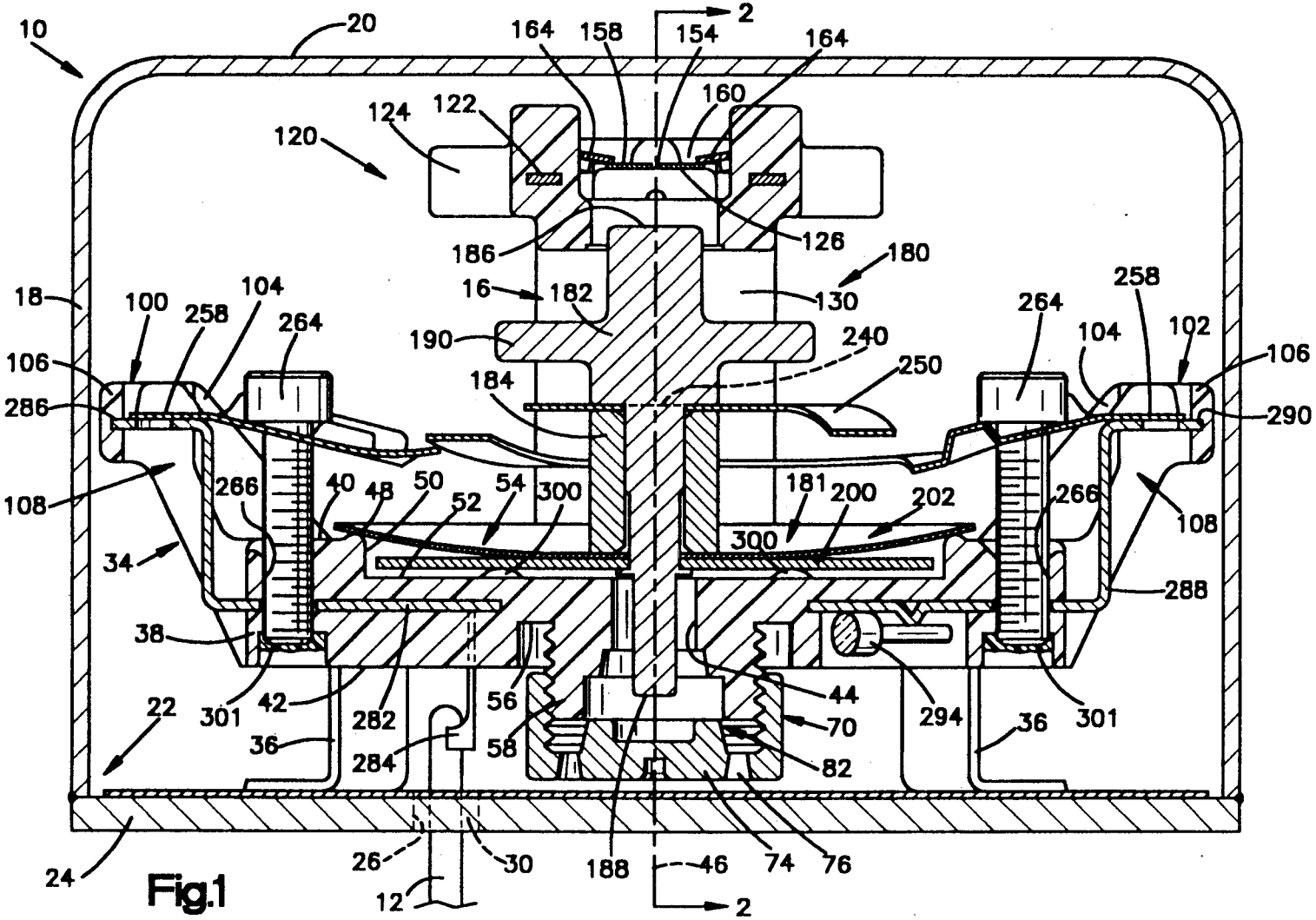
FIG. 1 is a sectional view of a gas damped deceleration switch embodying the present invention.

In accordance with a preferred embodiment of the present invention, a gas damped deceleration switch comprises a housing 10. A pair of electrical current carrying pins 12 and 14 (see FIGS. 1 and 2) extend from the housing 10 and connect the deceleration switch to an electrical circuit associated with a vehicle occupant safety device, such as an airbag inflator. A mass 16 is supported for movement in the housing 10 in response to deceleration. The mass 16 is movable from a rest position to an actuated position in which the mass 16 completes an electrical circuit between the two pins 12 and 14 to energize the safety device.

Structure

The housing 10 comprises a cylindrical cap 18 having a closed forward end 20 and an open rear end 22. A circular metal chassis 24 is attached to the cap 18 and hermetically seals the open rear end 22 of the cap 18. The chassis 24 includes a pair of apertures 26 and 28 through which the pins 12 and 14, respectively, extend. Glass seals 30 and 32 hermetically seal the apertures 26 and 28.

A plastic molded base 34 is rigidly supported in the housing 10 by four metal mounting supports 36 which connect the base 34 to the chassis 24. The base 34 comprises a substantially circular base platform 38 having a radially extending front side surface 40, a radially extending rear side surface 42, and a central passageway 44 communicating the front side surface 40 with the rear side surface 42. The passageway 44 is centered about an axis 46. As shown in enlarged detail in FIGS. 8*a* and 8*b*, the front side surface 40 comprises a raised annular surface with an axially projecting circular rim 48, a cylindrical surface 50 extending downwardly as shown in the drawings from the rim 48, and a bottom surface 52. The cylindrical surface 50 and the bottom surface 52 define a cavity 54 disposed radially inwardly of the circular rim 48. The rear side surface 42 of the base platform 38 includes a central annular recess 56 surrounding a rearwardly extending cylindrical protrusion 58 through which the passageway 44 extends. The cylindrical protrusion 58 has external threads 60 and a rear edge 62 where the passageway 44 terminates.

Figure 8A:
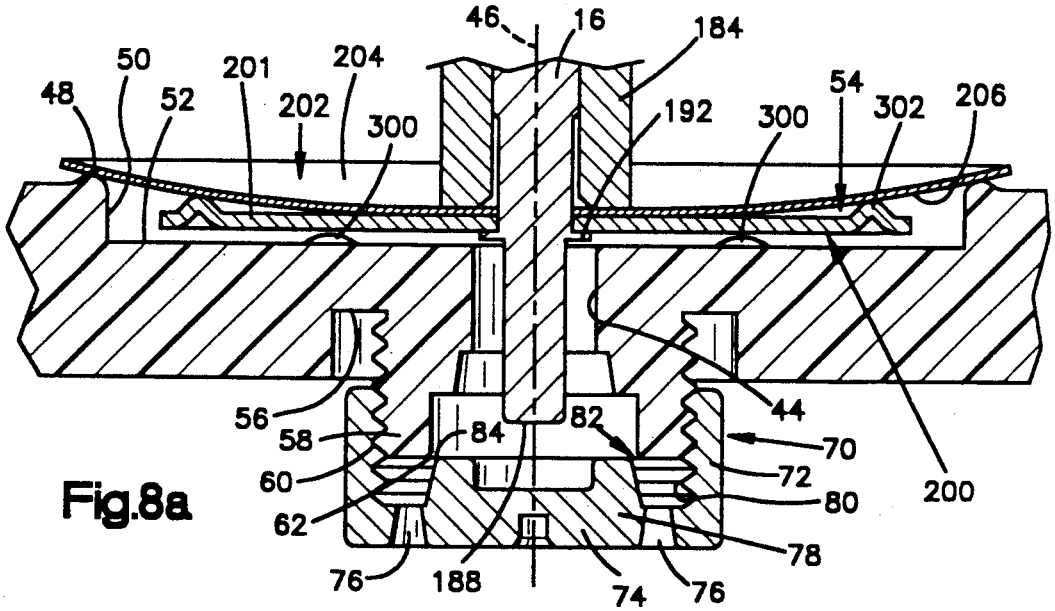
FIGS. 8*a*, 8*b* and 8*c* are sectional views including further alternate embodiments of the present invention.
Figure 8B:
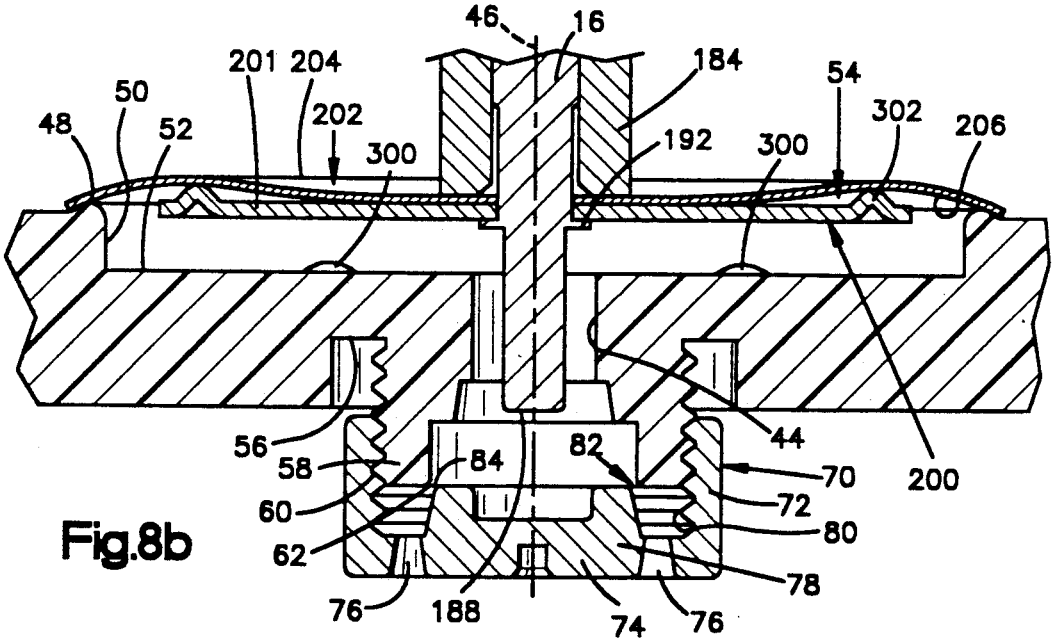

Also shown in enlarged detail in FIGS. 8*a* and 8*b* is a valve cap 70. The valve cap 70 comprises a cylindrical wall 72 and an end piece 74. A plurality of circumferentially spaced openings 76 extend through the end piece 74, and a cylindrical projection 78 extends forwardly from the end piece 74. The openings 76 lead to an annular gas flow space 82 defined between the rear edge 62 of the cylindrical protrusion 58 and a radially outer edge 84 on the cylindrical projection 78 on the end piece 74 of the valve cap 70. The cylindrical wall 72 of the valve cap 70 has internal threads 80 that engage the external threads 60 on the cylindrical protrusion 58 of the base platform 38. The valve cap 70 is movable axially relative to the base platform 38 to open and close the flow space 82 by rotating the valve cap 70 relative to the protrusion 58.

The base 34 further comprises a pair of diametrically opposed supporting arms 100, 102 extending axially forward from the base platform 38. The supporting arms 100, 102 are similarly constructed. Each supporting arm 100, 102 includes a pair of side walls 104, only one of each pair being shown in the drawings. The side walls 104 are joined by a cross member 106 which extends across a space 108 between the side walls 104. The base platform 38 also includes first and second mounting portions 110, 112 (see FIG. 2) at diametrically opposed locations which are offset approximately 90° from the diametrically opposed locations of the supporting arms 100, 102. The mounting portions 110, 112 are similarly constructed. Each mounting portion 110, 112 comprises a pair of spaced apart radial projections 114, only one of each pair being shown in the drawings.

An arch assembly 120 is rigidly supported on the base 34. The arch assembly 120 includes a bridge member 122, a plastic molded member 124, and a flexible electrical contact leaf 126. The bridge member 122 comprises a first upright section 130, a second upright section 132, and a cross piece 134 extending between the first and second upright sections 130, 132. The first upright section 130 is rigidly supported on the base 34 at the first mounting portion 110, and the second upright section 132 is rigidly supported on the base 34 at the second mounting portion 112.

Figure 11:
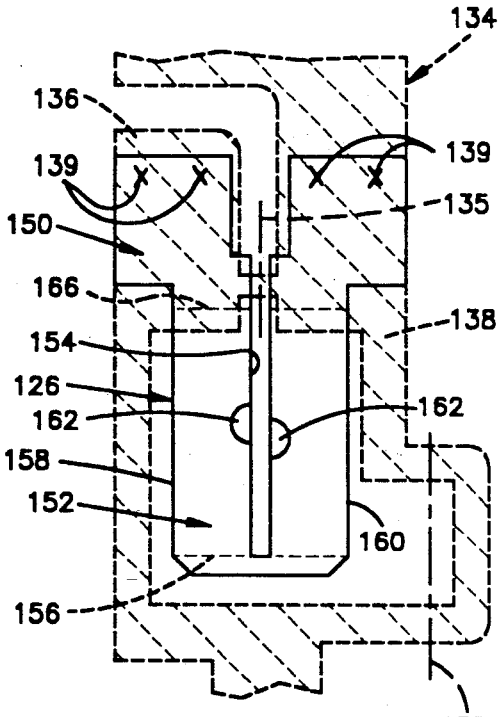
FIG. 11 is a plan view of a part of the gas damped deceleration switch.

The plastic molded member 124 of the arch assembly 120 is molded around the cross piece 134 of the bridge member 122. The plastic molded member 124 includes a shoulder surface 140, and a cylindrical inner surface 142 defining a circular upper passageway 144 which is coaxial with the passageway 44 extending through the base platform 38. After the plastic molded member 124 is molded around the cross piece 134, the cross piece 134 is cut along lines 135 as shown in FIG. 11 to divide the cross piece 134 into separate sections 136 and 138. The first section 136 is an extension of the first upright section 130 of the bridge member 122, and the second section 138 is an extension of the second upright section 132 of the bridge member 122.

Figure 2:
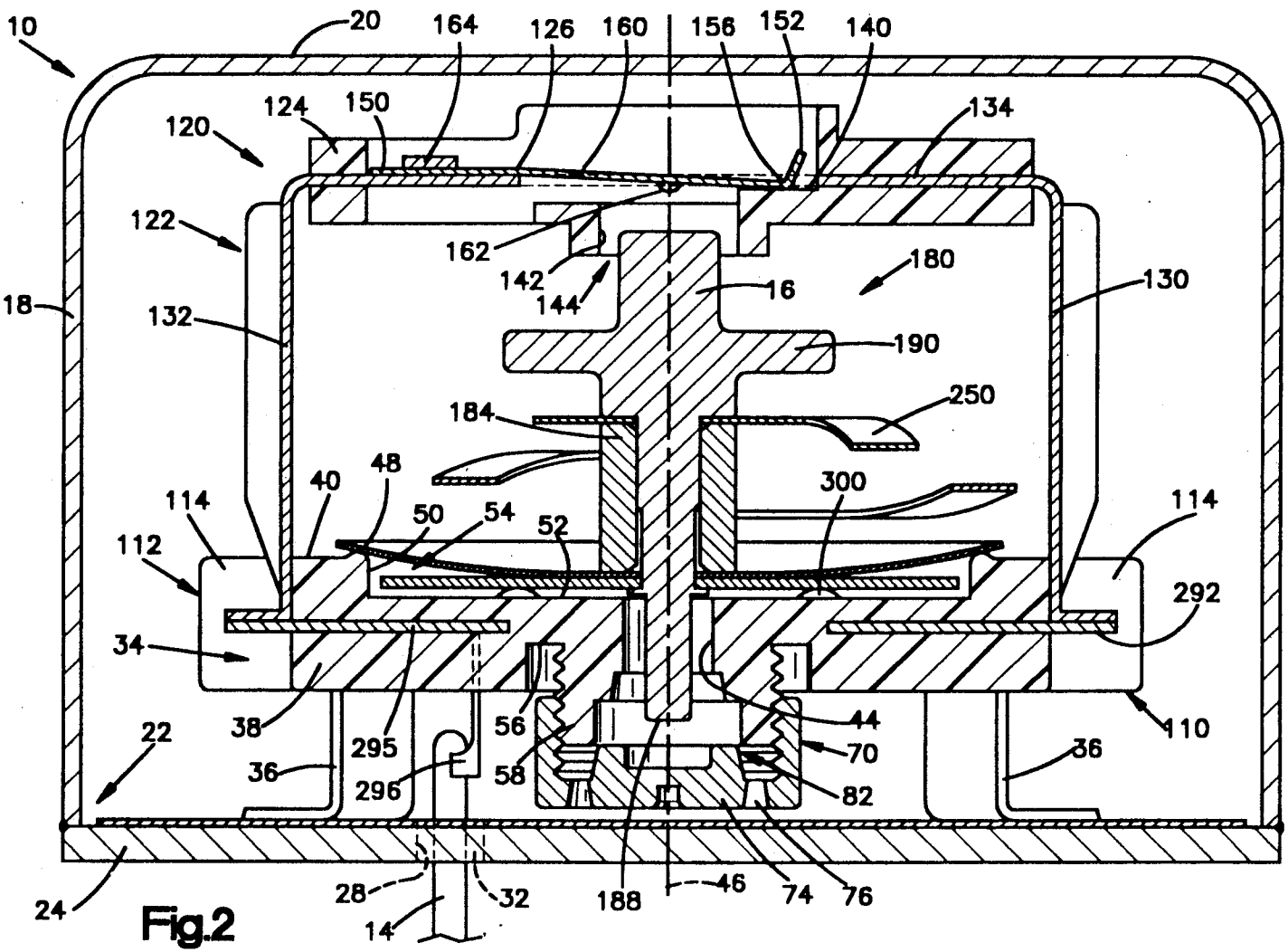
FIG. 2 is a sectional view taken on line 2—2 of FIG. 1.

As shown in FIGS. 2 and 11, the flexible contact leaf 126 is a rectangular piece of metal with a first end portion 150, a second end portion 152, and a centrally located slot 154 (FIG. 11) which extends from the first end portion 150 to a nearly 90° bend 156 at the second end portion 152. The slot 154 defines two spaced apart sections 158, 160 of the flexible contact leaf 126. Each section 158, 160 has a rearwardly extending dimple 162 at a position offset from the position of the other dimple.

The first end portion 150 of the flexible contact leaf 126 is clamped to the cross piece 134 of the bridge member 122 by means of a pair of contact retention tabs 164 (see FIG. 1) formed on the cross piece 134. Each section 158, 160 of the flexible contact leaf 126 is welded to a respective section 136, 138 of the cross piece 134 at welds 139 as shown in FIG. 11. The flexible contact leaf 126 thereby provides an electrically conductive connection between the first and second upright sections 130, 132 of the bridge member 122 through the sections 136, 138 of the cross piece 134.

The second end portion 152 of the flexible contact leaf 126 rests on the shoulder surface 140 of the plastic molded member 124. The flexible contact leaf 126 has an intermediate bend 166 such that the second end portion 152 is biased toward the shoulder surface 140. The second end portion 152 of the flexible contact leaf 126 can resiliently move axially back toward the shoulder surface 140 after being moved axially away from the shoulder surface 140.

Figure 7A:
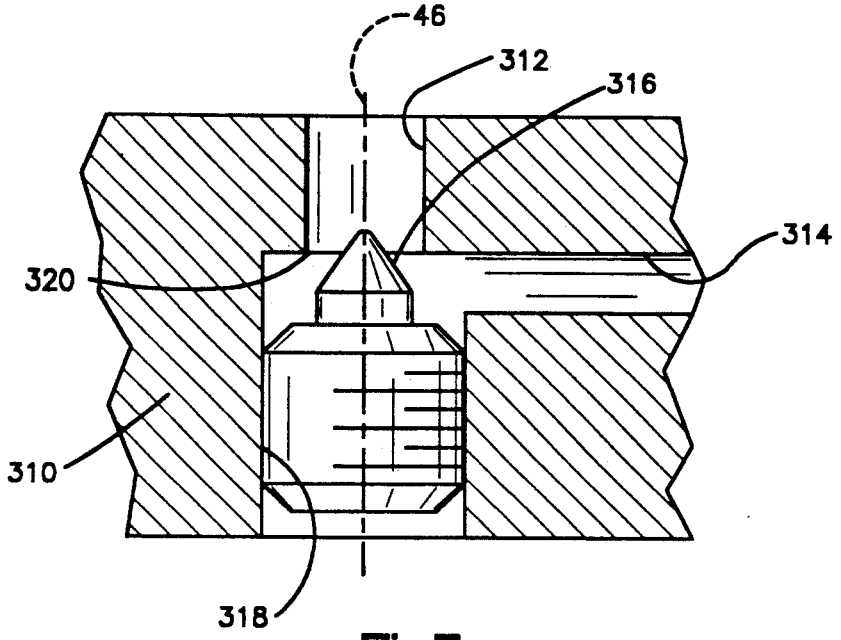
FIGS. 7*a* and 7*b* are fragmentary sectional views including alternate embodiments of the present invention.
Figure 7B:
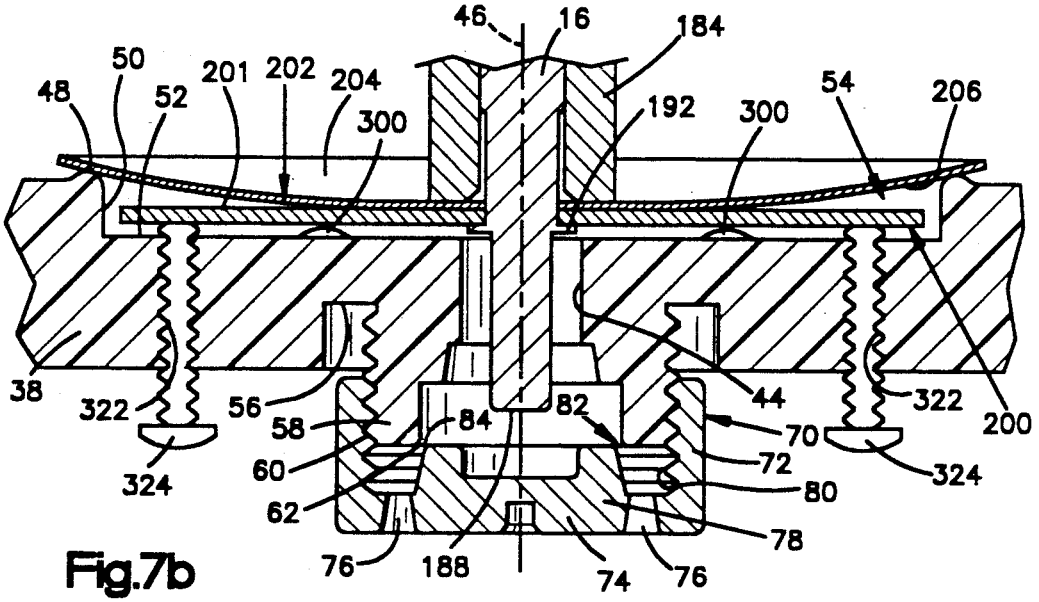

An elongated mass assembly 180 comprises the mass 16 and a damping disk assembly 181 (see FIG. 1). The mass 16 comprises a body member 182 and a spacer 184. The body member 182 is circular in cross section and has a forward end 186, a rear end 188, an upper flange 190 and a lower flange 192 (FIG. 7*b*). The spacer 184 is a sleeve received over a portion of the body member 182, and is held in place by the lower flange 192. In the preferred embodiment, the body member 182 and the spacer 184 are formed of brass.

Figure 6B:
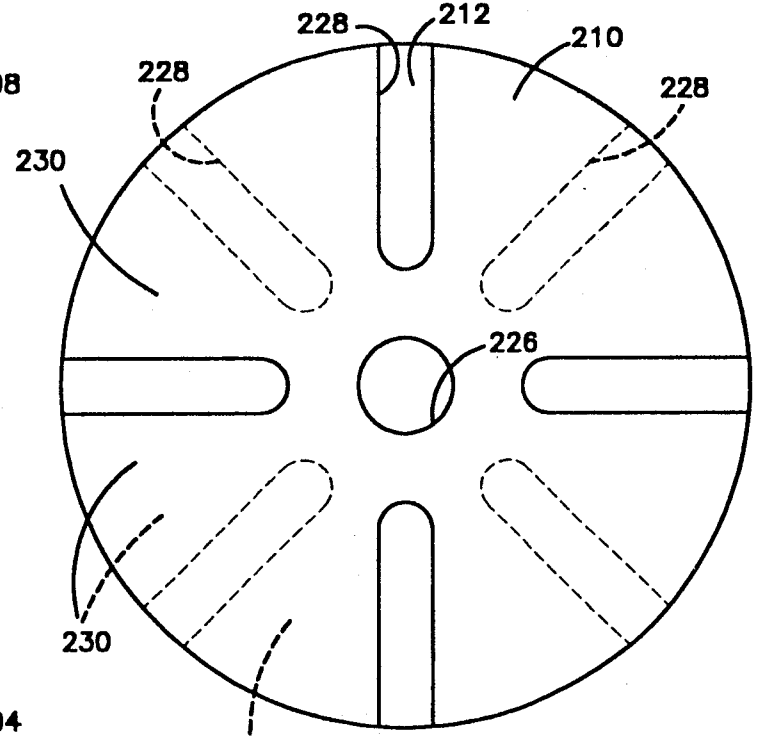
FIGS. 6*a* and 6*b* are plan views of parts of the gas damped deceleration switch of FIG. 1.
Figure 6A:
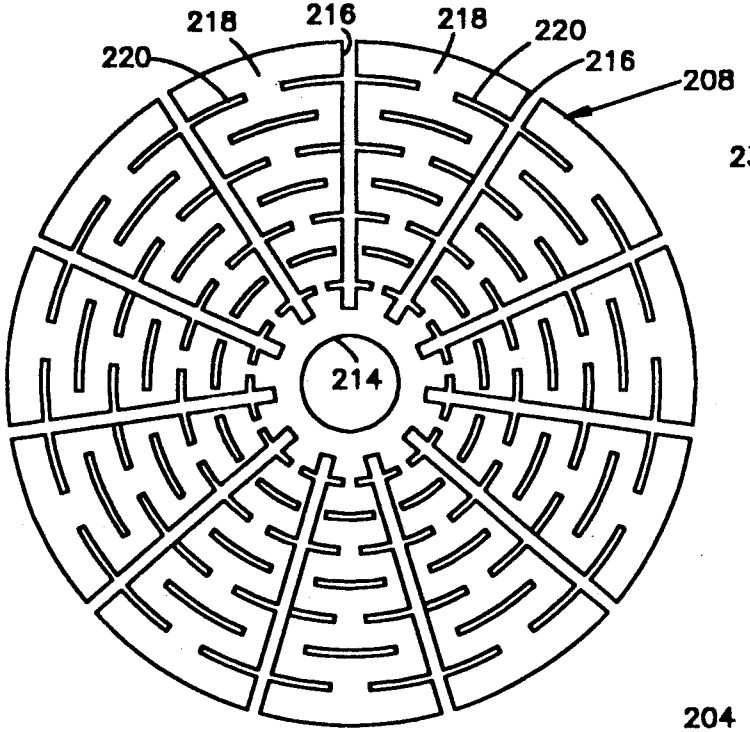
Figure 6C:
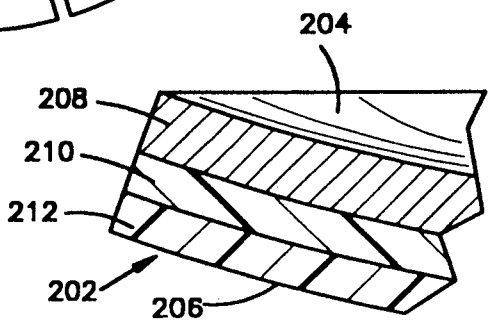
FIG. 6*c* is a fragmentary sectional view of the parts shown in FIGS. 6*a* and 6*b* in an assembled relationship.

The damping disk assembly 181 is preferred to have a circular shape and includes a rigid disk component 200 comprising an aluminum main disk 201. The damping disk assembly also includes a flexible disk component 202 having a diameter greater than the diameter of the main disk 201. The flexible disk component 202 has a front surface 204 and a rear surface 206. The flexible disk component 202 comprises a spring portion in the preferred form of a flexible metal disk spring 208 (see FIGS. 6*a*, 6*c*), and a sealing portion in the preferred form of two flexible disks 210, 212 (FIGS. 6*b*, 6*c*). The flexible metal disk spring 208 has a central opening 214 and radially extending slots 216 defining circumferentially spaced segments 218. The segments 218 include circumferentially extending slots 220. The two flexible disks 210, 212 are similarly constructed with diameters preferably equal to the diameter of the metal disk spring 208. The flexible disks 210, 212 each include a central opening 226, and radially extending slots 228 defining circumferentially spaced segments 230. The flexible disks 210, 212 overlie one another with the slots 228 of each flexible disk being offset approximately 45° from the slots 228 of the other flexible disk. The flexible disk component 202 of the damping disk assembly 181 has a flat, planar unflexed condition prior to assembly in the deceleration switch.

The damping disk assembly 181 is securely mounted coaxially on the mass 16 between the spacer 184 and the lower flange 192. The elongated mass assembly 180, comprising the mass 16 and the damping disk assembly 181, has its center of mass located at a position which lies in the perpendicular transverse plane 240 shown in FIG. 1. In the preferred embodiment, the center of mass of the elongated mass assembly is located on the axis 46.

Figure 9:
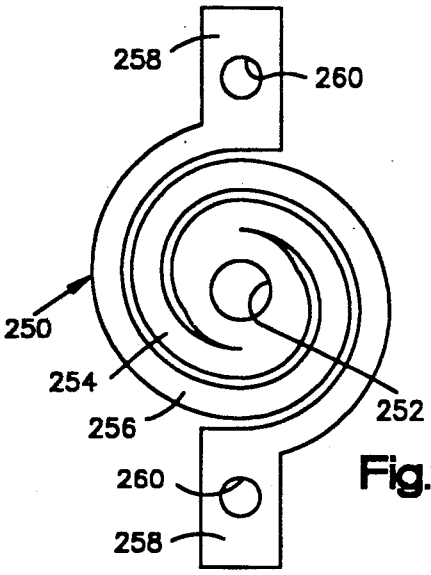
FIG. 9 is a plan view of a part of the gas damped deceleration switch of FIG. 1.

The elongated mass assembly 180 is attached to the base 34 by means of a spiral spring 250. The spiral spring 250 has a central opening 252, and a pair of spiral legs 254, 256 (see FIG. 9). Each of the spiral legs 254, 256 has a terminal portion 258 which includes a hole 260. The central opening 252 of the spiral spring 250 is received coaxially over the mass 16 at an axial position which lies in the plane 240. The spiral spring 250 is thereby connected to the elongated mass assembly 180 at a position longitudinally aligned with the center of mass of the elongated mass assembly 180. The spiral spring 250 is held in place by the spacer 184 and by a weld (not shown). A respective spring adjustment screw 264 extends through each of the holes 260 in the terminal portions 258 of the spiral legs 254 and 256, and is received in a threaded opening 266 in the base 34. The spring adjustment screws 264, when rotated, move axially relative to the base 34 and adjust the axial loading of the spiral spring 250 on the elongated mass assembly 180.

The terminal portions 258 of the spiral legs 254 and 256 extend radially beyond the spring adjustment screws 264 into the spaces 108 between the side walls 104 of the supporting arms 100, 102 of the base 34. The elongated mass assembly 180 is thus supported on the base 34 for forward axial movement against the bias of the spiral spring 250, and for return, rearward axial movement under the bias of the spiral spring 250. The spiral spring 250 has a flat, planar unflexed condition prior to assembly in the deceleration switch.

A plurality of electrically conductive metal inserts are included in the base 34 to define a diagnostic circuit and a firing circuit. A first insert 282 (FIG. 1) extends from a pin connector portion 284 at the electrical pin 12 through the base platform 38, and further through the space 108 within the first supporting arm 100 to the cross member 106. The first insert 282 has a spring contact surface 286 against which a projected portion 258 of the spiral spring 250 is welded. A second insert 288 extends from the cross member 106 of the other supporting arm 102 through the other space 108 and into the base platform 38. The second insert 288 has a spring contact surface 290 against which the other projected portion 258 of the spiral spring 250 is welded. A third insert 292 (FIG. 2) extends from a position within the base platform 38 to a position outward of the base platform 38 in contact with the first upright section 130 of the bridge member 122 at the first mounting portion 110. An electrical resistor 294 connects the second insert 288 to the third insert 292. A fourth insert 295 extends from a position in contact with the second upright section 132 of the bridge member 122 at the second mounting portion 112 through the base platform 38 to a pin connector portion 296 to which the other electrical pin 14 is connected.

Figure 10:
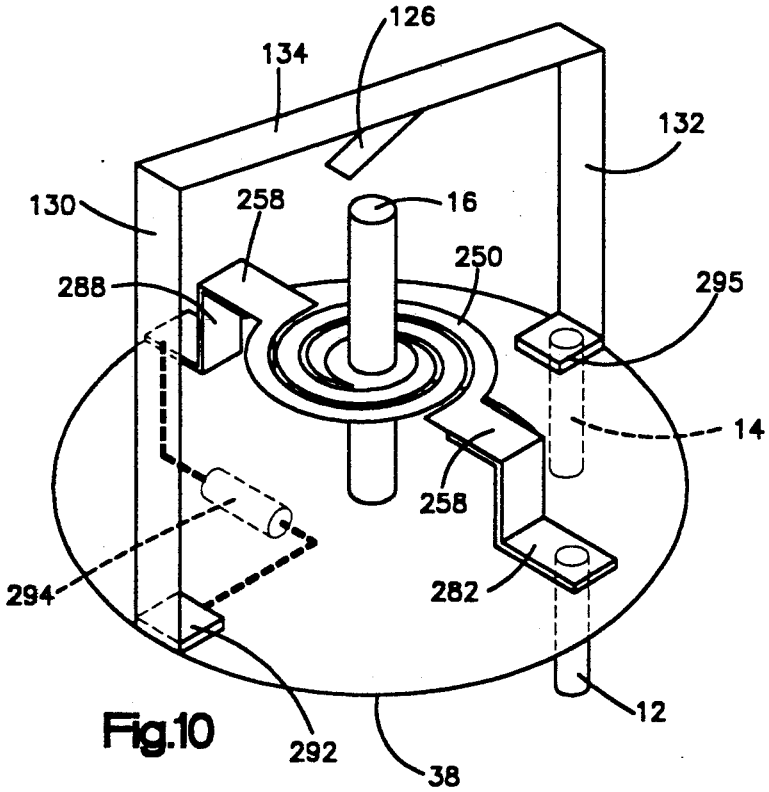
FIG. 10 is a schematic perspective view of the parts of the gas damped deceleration switch of FIG. 1 which carry electrical current.

As shown schematically in FIG. 10, the diagnostic circuit follows a path from the electrical pin 12 through the first insert 282 to the spiral spring 250, across the spiral spring 250 through the mass 16, and further from the spiral spring 250 through the second insert 288. The diagnostic circuit continues through the resistor 294 from the second insert 288 to the third insert 292, from the third insert 292 across the bridge member 122 through the contact leaf 126 to the fourth insert 295, and finally through the fourth insert 295 to the electrical pin 14. A diagnostic test current, when applied between the electrical pins 12 and 14 through the diagnostic circuit, is at a level below that which would activate the passenger safety device associated with the deceleration switch, as is known.

The firing circuit is normally open, and is closed when the mass 16 is moved axially into contact with the flexible contact leaf 126. The firing circuit follows the path of the diagnostic circuit from the first electrical pin 12 to the mass 16, but bypasses the resistor 294 by continuing from the mass 16 directly to the cross piece 134 of the bridge member 122 through the flexible contact leaf 126. The firing circuit then continues on a path from the bridge member 122 to the electrical pin 14 through the fourth insert 294 and the pin connector 296. The firing current, when applied between the electrical pins 12 and 14 and bypassing the resistor 294, is at an elevated level which is sufficient to activate the passenger safety device.

Operation

Figure 4:
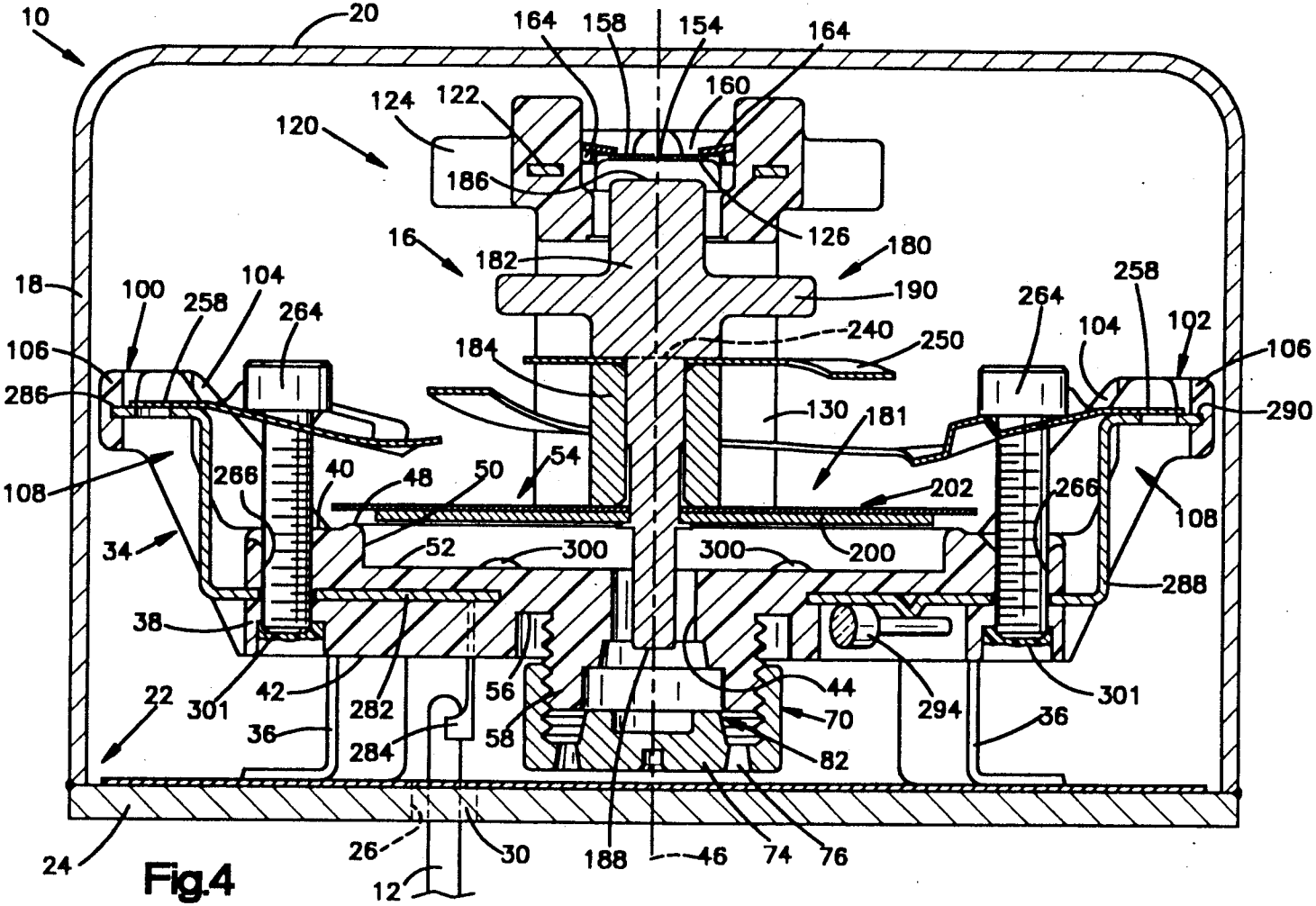
Figure 5:
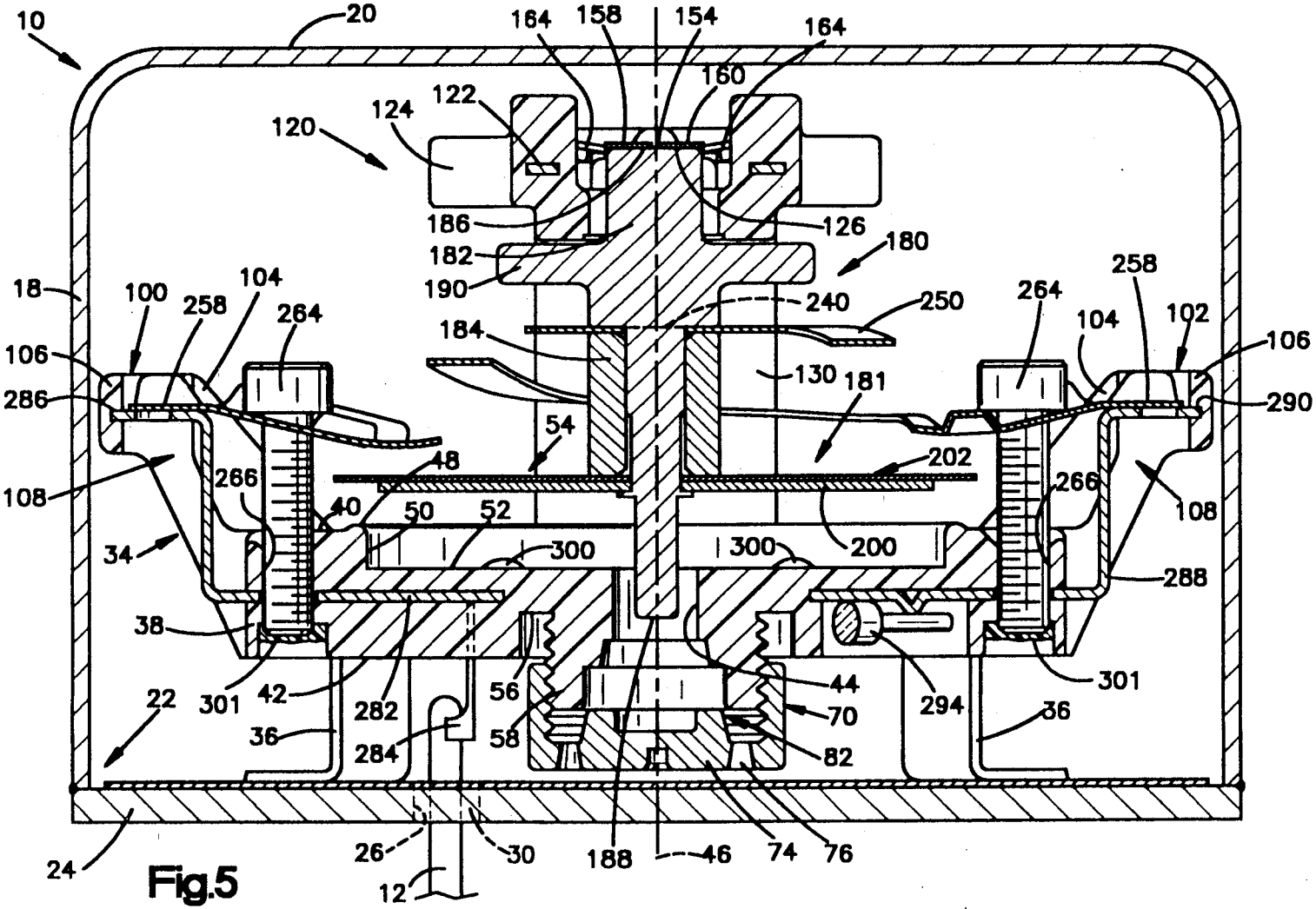

The deceleration switch operates to activate a vehicle occupant safety device in response to a decelerating crash pulse experienced by a vehicle carrying the deceleration switch. Deceleration of the vehicle will urge the elongated mass assembly 180 to move forward relative to the base 34. If a decelerating crash pulse has sufficient magnitude and duration, the elongated mass assembly 180 will move forward from the rest position shown in FIGS. 1 and 2 past the successive positions shown in FIGS. 3 and 4, and to the actuated position shown in FIG. 5. When the elongated mass assembly 180 is in the actuated position, the mass 16 contacts the flexible contact leaf 126 to close the firing circuit to activate the vehicle occupant safety device.

When the elongated mass assembly 180 is held in the rest position by the spiral spring 250 as shown in FIGS. 1 and 2, the damping disk assembly 181 is in an initial position. The main disk 201 is held against four supporting pads 300 on the bottom surface 52 of the cup-shaped portion of the base platform 38, and the rear surface 206 of the flexible disk component 202 is held against the raised circular rim 48 of the cup-shaped portion of the base platform 38. The flexible disk spring 208 is biased by the spiral spring 250 to flex inwardly of the cup-shaped portion of the base platform 38, and holds the two flexible disks 210 and 212 against the raised circular rim 48 due to the tendency of the flexible disk spring 208 to return to its originally flat, unflexed condition.

The flexible disks 210 and 212 provide a continuous gas seal between the rear surface 206 and the rim 48. For this purpose, the flexible disks 110, 112 are preferred to be formed of the material known by the trademark Kapton, a trademark of E. I. DuPont de Nemours and Company. An initial volume of space is defined within the cavity 54 between the surface 40 of the base platform 38 and the rear surface 206 of the flexible disk component 202 when the damping disk assembly 181 is in the initial position.

Figure 3:
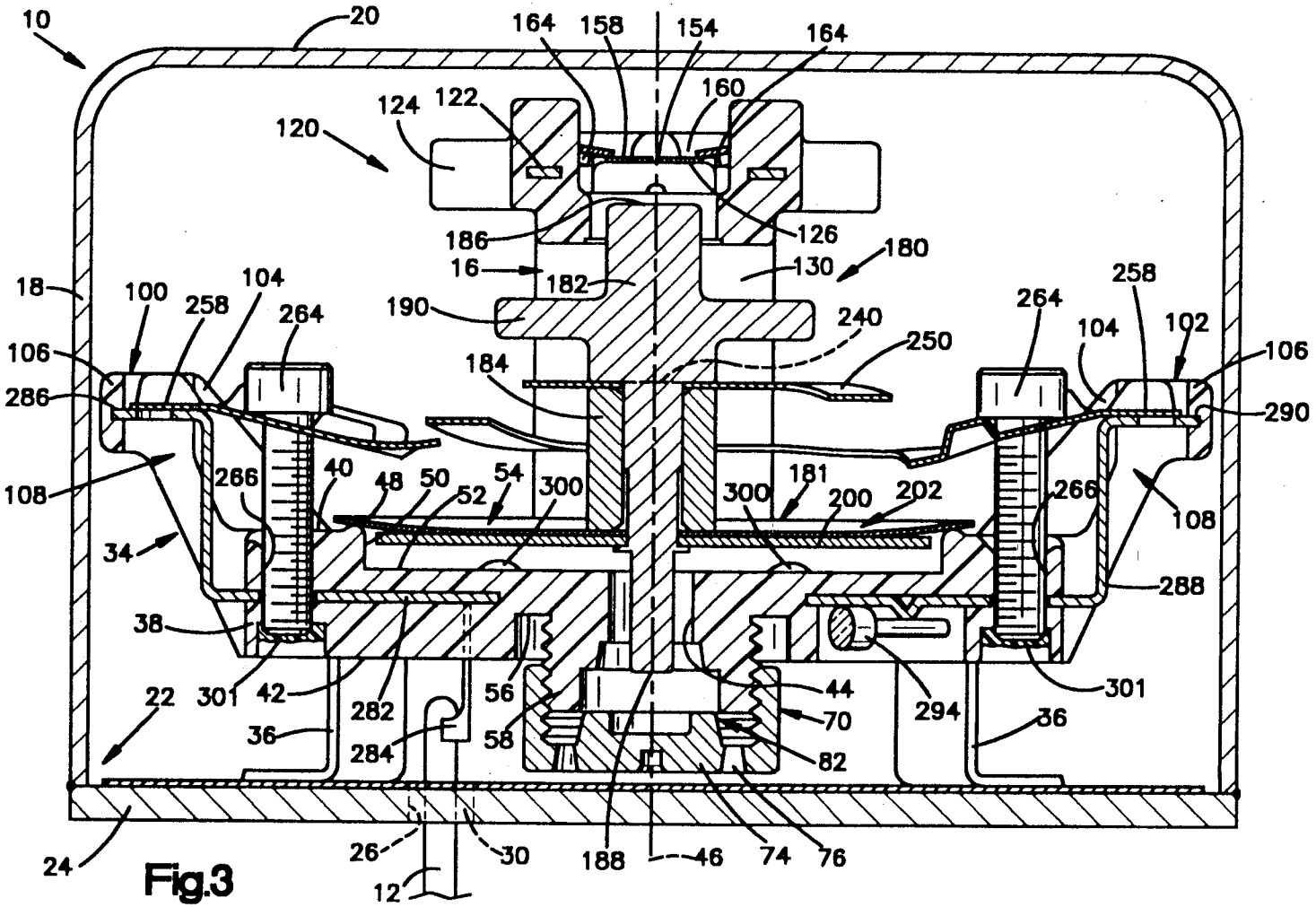
FIGS. 3, 4 and 5 are sectional views of the gas damped deceleration switch of FIG. 1 illustrating parts in different positions.

When the elongated mass assembly 180 is moved from the rest position shown in FIGS. 1 and 2 to the position shown in FIG. 3, the damping disk assembly 181 is carried with the moving mass 16 from the initial position shown in FIGS. 1 and 2 to the advanced position shown in FIG. 3. When the damping disk assembly 181 is in the advanced position, the flexible disk spring 208 still holds the flexible disks 210 and 212 firmly against the rim 48, but is resiliently flexed back from its initial position toward its flat, unflexed condition. An advanced volume of space greater than the initial volume of space is then defined within the cavity 54. Flexing of the flexible disk spring 208 back toward its unflexed condition moves it axially relative to the main disk 201 such that the main disk 201 is moved into greater overlying surface contact with the rear surface 206 of the flexible disk component 202.

Upon further forward axial movement of the elongated mass assembly 180 beyond the position shown in FIG. 3, the main disk 201 will fully engage the rear surface 206 of the flexible disk component 202 to move the rear surface 206 out of engagement with the rim 48. The damping disk assembly 181 then occupies the open position shown in FIG. 4, and the flexible disk component 202 returns to its unflexed condition as the elongated mass assembly 180 continues toward the actuated position shown in FIG. 5. The upper flange 190 of the mass 16 limits forward axial movement of the elongated mass assembly 180.

Damping gas contained within the housing 10 will exert a damping force against the forwardly moving front surface 204 of the flexible disk component 202. Movement of the flexible disk assembly 181 axially forward from the initial position to the advanced position increases the volume of the space defined within the cavity 54 between the rear surface 206 of the flexible disk component 202 and the bottom surface 52 on the base platform 38. This increase in the volume causes a decrease in the pressure of the gas contained within that space and generates a vacuum (pressure reduction) in that space. Generation of a vacuum causes the damping gas in the housing 10 to exert an increased damping force against the forward surface 204 of the moving flexible disk component 202. Also, a flow of gas is directed into the vacuum through the passageway 44 extending through the base platform 38. The flow of gas through the passageway 44 is controlled by means of the threaded valve cap 70.

Moving vehicles sometimes experience a hammer blow type of deceleration pulse upon impact with an object or an uneven road surface. Such a hammer blow type of pulse will be transmitted to a deceleration switch carried on the vehicle frame. The deceleration switch may also experience a direct impact hammer blow if struck by debris in the road or by a maintenance person servicing the vehicle. A hammer blow deceleration pulse may have the magnitude of an actual crash pulse in terms of deceleration, but will have a duration substantially less than the duration of an actual crash pulse. A deceleration switch should not activate a passenger safety device such as an airbag inflator in response to a hammer blow deceleration pulse, and therefore should not close the firing circuit in response to a deceleration pulse having an elevated magnitude and a low duration indicative of a hammer blow against the vehicle. In accordance with the present invention, operation of the deceleration switch as shown in the Figures is calibratable to assure that the mass 16 will not be moved into contact with the flexible contact leaf 126 in response to a hammer blow deceleration pulse.

In the preferred embodiment, calibration of the deceleration switch is accomplished by means of the threaded valve cap 70. Movement of the valve cap 70 axially with respect to the rear surface 42 of the base platform 38 regulates the flow area of the annular gas flow space 84 and thereby regulates the flow of gas directed into the vacuum which is generated by movement of the damping disk assembly 181.

For a given rate of forward axial movement of the elongated mass assembly 180, which causes an increase in the volume between the rear surface 206 of the flexible disk component 202 and the bottom surface 52 on the base platform, a relatively restricted gas flow rate through the valve cap 70 will result in a higher vacuum for a longer time than will a relatively greater gas flow rate. As a result, a deceleration pulse which urges the elongated mass assembly 180 to move axially forward at a given rate will be resisted by a higher gas damping force acting against the front surface 204 for a longer period of time. The deceleration pulse must therefore have a duration sufficient to sustain movement of the elongated mass assembly 180 against the increased gas damping force until the damping disk assembly 181 is moved past the advanced position and into the open position. If the deceleration pulse does not have a sufficient duration to move the damping disk assembly 181 into the open position, the bias of the spiral spring 250 will move the elongated mass assembly 180 back into the closed position. Adjustment of the valve cap 70 to enlarge the annular gas flow space 84 will increase the flow rate of gas directed into the vacuum and will decrease the time required for the flow of gas to relieve the vacuum. This will decrease the duration of a deceleration pulse required to sustain movement of the elongated mass assembly against the damping force caused by generation of the vacuum. The deceleration switch is thus calibratable to control closing of the firing circuit. When calibration is complete, an adhesive is applied as needed to lock the valve cap 70 against rotation relative to the base 34.

It is also desirable to avoid closing of the firing circuit in response to a hard braking deceleration pulse having a relatively low magnitude but a long duration indicative of an actual crash pulse. In order to increase the magnitude of a deceleration pulse which is required to move the mass assembly 180 forward from the rest position, the spring adjustment screws 264 can be adjusted to increase the axial loading of the spiral spring 250 on the elongated mass assembly 180. The deceleration switch can thereby be adjusted so that the elongated mass assembly 180 will be movable into the actuated position only by a deceleration pulse having a selected magnitude greater than the magnitude of a hard braking deceleration pulse. An adhesive 301 can be applied to hold the spring adjustment screws at a desired setting in the threaded openings 266 in the base 34.

Performance Enhancement Features

Several features of the invention are designed to enhance the performance of the deceleration switch. As shown in FIGS. 6*a* through 6*c*, the disks comprising the preferred form of the flexible disk component 202 of the damping disk assembly 181 have radially extending slots defining circumferentially spaced segments of the disks. The slotted, segmented configuration of the disks increases the flexibility of the flexible disk component 202. Importantly, relatively greater flexibility allows the use of relatively stiffer materials. Relatively stiffer materials will resist expansion and contraction in response to temperature changes, and will perform more consistently over a wide range of temperatures experienced by the vehicle carrying the deceleration switch.

An optional feature of the invention designed for enhancement of the performance of the deceleration switch is shown in FIGS. 8*a* and 8*b*. A raised circular ring 302 extends around the main disk 201 adjacent its outer periphery. When the elongated mass assembly 180 is in the rest position, the damping disk assembly 181 takes the same initial closed position as shown in FIGS. 1 and 2. When the deceleration switch experiences a deceleration pulse of a given magnitude and short duration, the vacuum within the cavity 54 is generated more suddenly than when the deceleration switch experiences a deceleration pulse of equal magnitude but longer duration. The more suddenly generated vacuum causes a relatively greater pressure differential across the flexible disk component 202 of the damping disk assembly 181. The relatively greater pressure differential holds the periphery of the flexible disk component 202 against the rim 48 on the base platform 38 as the raised ring 302 on the main disk 201 moves the flexible disk component 202 to flex into the over-bent condition shown in FIG. 8*b*. By moving into the over-bent condition, the flexible disk component 202 remains sealed against the rim 48 for a greater portion of the axial travel distance of the elongated mass assembly 180 during short duration, hammer blow deceleration pulses. When the hammer blow deceleration pulse terminates, the damping disk assembly 181 can move back from the over-bent condition to the initial position shown in FIGS. 1 and 2 under the bias of the spiral spring 250. The raised ring 302 therefore acts as a performance enhancement feature which provides the deceleration switch with greater resistance to movement of the elongated mass assembly 180 into the actuated position in response to hammer blow deceleration pulses.

Figure 8C:
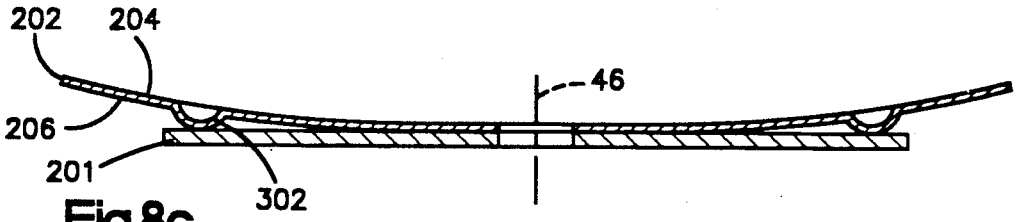

As an alternate design of the performance enhancement feature shown in FIGS. 8*a* and 8*b*, a raised ring 302 could be provided on the rear surface 206 of the flexible disk component 202 as shown in FIG. 8*c*. Another design alternative which would produce the over-bent condition is a reduction in the diameter of the main disk 201. A main disk 201 with a reduced diameter would permit a greater degree of flexure between the periphery of the main disk 201 and the sealed periphery of the flexible disk component 202 when the damping disk assembly 181 moves into the advanced position shown in FIG. 3.

Additionally, the main disk 201, the flexible disk component 202, and/or the rim 48 on the base platform 38 could be disposed at acute angles with respect to one another as opposed to being disposed as shown in the drawings. If the main disk 201 extends at an acute angle across the axis 46 instead of being perpendicular to the axis 46, one radial side of the moving main disk 201 will contact the flexible disk component 202 before the diametrically opposed other radial side of the moving main disk 201 contacts the flexible disk component 202. During a hammer blow type of deceleration pulse which generates a relatively greater pressure differential across the flexible disk component 202, movement of the main disk 201 against only one radial side of the flexible disk component 202 will not be sufficient to overcome the pressure differential in order to move the flexible disk component 202 away from the raised circular rim 48. A deceleration pulse would have to be of a duration sufficient to move both radial sides of an acutely extending main disk 201 against the flexible disk component 202 in order to move the flexible disk component 202 away from the raised circular rim 48. An acutely extending main disk 201 would thereby provide enhanced resistance to hammer blow deceleration pulses.

An additional performance enhancement feature of the present invention relates to the flexible electrical contact leaf 126. As the mass 16 moves axially against the contact leaf 126, the contact leaf 126 may be caused to vibrate. A unitary contact leaf would vibrate between positions in contact with the mass 16 and positions out of contact with the mass 16. The firing circuit would then experience interruptions during vibration of the contact leaf. However, the two sections 158 and 160 of the slotted flexible contact leaf 126 will vibrate independently because they are separate. Furthermore, the dimples 162 against which the mass 16 moves are offset from one another. The mass will thus impact the two sections 158, 160 at different positions between the ends of the flexible contact leaf 126. This will also cause the two sections 158, 160 to vibrate differently from one another. The two sections 158 and 160 are therefore not likely to be vibrated out of contact with the mass 16 at the same time, because they vibrate differently from one another. The closed firing circuit is thereby maintained more continuously.

Another performance enhancement feature of the present invention relates to the spiral spring 250 and the elongated mass assembly 180. The spiral spring 250 is connected to the elongated mass assembly 180 at the axial position of the center of mass of the elongated mass assembly 180. This assures that the elongated mass assembly 180 will not pivot out of its position centrally aligned with the axis 46 in response to a transverse component of a deceleration pulse. The force of an axially transverse component of a deceleration pulse will be transmitted from the base 34 through the spiral spring 250 to the mass 16 at the axial position where the moment arm along the axis 46 between the transmitted force and the center of mass of the elongated mass assembly 180 is equal to zero. The force of a transverse component of a deceleration pulse will therefore be applied to the elongated mass assembly 180 at the axial position wherein the elongated mass assembly 180 is least susceptible to being pivoted or shifted out of its orientation centrally aligned with the axis 46. The moving mass 16 will be restrained by the spiral spring 250 from moving into sliding frictional contact with the surface of the passageway 44 or the surface of the central opening 144. Since the amount of sliding friction would differ with different transverse forces, more consistent performance of the deceleration switch is obtained by minimizing sliding friction. This feature of the invention not only provides consistency for the performance of a deceleration switch which is axially aligned with the usual forward direction of a vehicle, but also provides consistency in the performance of a deceleration switch which may be aligned axially transversely to the usual forward direction of a vehicle.

Alternate Embodiments

Alternate means for calibrating the deceleration switch in accordance with the invention are shown in FIGS. *7a* and *7b*. As shown in FIG. *7a*, a base platform 310 includes a gas flow passage having component sections 312 and 314. A threaded needle valve 316 is movable axially in a bore 318 to regulate the flow of gas through the juncture 320 between the passage sections 312 and 314.

As shown in FIG. *7b*, there is another calibrating mechanism which may be used alternately or in addition to the valve. This calibrating mechanism comprises a pair of threaded bores 322 extending axially between the rearward surface 42 of the base platform 38 and the bottom surface 52 of the cup-shaped portion of the base platform 38. Two threaded support pins 324 are received in the bores 322 and are movable axially into and out of the cavity 54 within the cup-shaped portion of the base platform 38. The support pins 324 can be moved into engagement with the main disk 201 to move the main disk 201 adjustably away from the support pads 300, and thereby to vary the initial volume of space defined within the cavity 54 by the damping disk assembly 181 when in its initial position. The change in volume, and the gas damping force caused by the vacuum which is generated by the change in volume, are therefore made adjustable by the threaded support pins 324.

From the above description of a preferred embodiment of the invention, those skilled in the art will perceive improvements, changes and modifications. Such improvements, changes and modifications within the skill of the art are intended to be covered by the appended claims.

Having described preferred embodiments of the invention, the following is claimed:

1. A gas damped deceleration sensor comprising:

a movable mass;

means for supporting said mass for movement in response to deceleration;

means for sensing a predetermined amount of said movement of said mass to indicate a predetermined amount of deceleration over a time interval;

a structure having a first surface;

a flexible damping disk assembly having a second surface, said damping disk assembly having a position wherein said second surface is engaged with a portion of said first surface to define a space between said structure and said damping disk assembly;

said damping disk assembly being connected to said mass to flex relative to said base from said position to enlarge said space and to cause a pressure reduction in said space in response to said movement of said mass, said pressure reduction restraining movement of said mass; and said damping disk assembly comprising a flexible sealing disk having said second surface, and a flexible spring disk which biases said flexible sealing disk toward said first surface when said damping disk assembly is in said position.

2. A gas damped sensor mechanism comprising:

a base having a base surface;

a mass;

means for supporting said mass for movement relative to said base;

means for sensing a predetermined amount of movement of said mass relative to said base;

a damping assembly connected to said mass for movement with said mass relative to said base, said damping assembly having an initial position wherein said damping assembly and said base surface define a chamber having an initial volume, movement of said damping assembly relative to said base increasing the volume of said chamber and causing a pressure reduction in said chamber, said pressure reduction restraining movement of said damping assembly and said mass relative to said base; and said damping assembly comprising a plurality of damping members including a flexible damping member.

3. A sensor mechanism as defined in claim 2 wherein said flexible damping member is a disk.

4. A sensor mechanism as defined in claim 2 wherein said damping members further include a flexible spring member which biases said flexible damping member into a flexed condition when said damping assembly is in said initial position, said flexible damping member moving from said flexed condition toward an unflexed condition when said damping assembly moves to increase the volume of said chamber.

5. A sensor mechanism as defined in claim 4 further comprising a rigid damping member connected to said mass for movement with said mass relative to said base.

6. A sensor mechanism as defined in claim 5 wherein said rigid damping member is a disk, said flexible damping member being a disk with a diameter greater than the diameter of said rigid damping member, said flexible damping member being connected to said mass coaxially with said rigid damping member and being in overlying contact with said rigid damping member when in said unflexed condition.

7. A sensor mechanism as defined in claim 2 further comprising a rigid damping member connected to said mass at a position adjacent to said flexible damping member, and spacing means for holding said flexible damping member in a flexed condition throughout movement of said damping assembly relative to said base.

8. A sensor mechanism as defined in claim 7 wherein said rigid damping member and said flexible damping member are disks coaxially connected to said mass, said spacing means comprising an axially projecting surface portion of said flexible damping member.

9. A sensor mechanism as defined in claim 7 wherein said rigid damping member and said flexible damping member are disks coaxially connected to said mass, said spacing means comprising an axially projecting surface portion of said rigid damping member.

10. A sensor mechanism as defined in claim 2 wherein said damping members further include a rigid damping member, said flexible damping member having a position in overlying surface contact with said rigid damping member.

11. A sensor mechanism as defined in claim 10 wherein said rigid damping member and said flexible damping member are disks, said flexible damping member having a peripheral portion extending radially beyond the periphery of said rigid damping member.

12. A sensor mechanism as defined in claim 10 wherein said flexible damping member moves into increasing overlying surface contact with said rigid damping member when said damping assembly moves to increase the volume of said chamber.

13. A sensor mechanism as defined in claim 12 wherein said flexible damping member moves into a flat, unflexed condition in overlying surface contact with said rigid damping member when said damping assembly moves to increase the volume of said chamber.

14. A sensor mechanism as defined in claim 1 wherein said sensing means comprises means for defining an electrical current path along which electric current flows in response to a predetermined amount of movement of said mass relative to said base.

15. A gas damped sensor mechanism comprising:

a base having a first surface;

a mass;

means for supporting said mass for movement relative to said base;

means for sensing a predetermined amount of movement of said mass relative to said base;

a movable damping assembly having a second surface facing said first surface, having an initial position wherein said second surface is engaged with said first surface to define a space having an initial volume between said base and said damping assembly, and having an open position wherein said second surface is disengaged from said first surface;

said damping assembly being connected to said mass to move from said initial position toward said open position to enlarge the volume of said space and to cause a pressure reduction within said space in response to a first amount of movement of said mass relative to said base and to move into said open position in response to a second amount of movement of said mass relative to said base, said pressure reduction restraining movement of said mass relative to said base; and said damping assembly comprising a flexible sealing layer having said second surface, and a flexible spring layer biasing said flexible sealing layer against said first surface when said damping assembly is in said initial position.

16. A sensor mechanism as defined in claim 15 wherein said spring layer of said damping assembly biases said sealing layer against said first surface during said first amount of movement of said mass.

17. A sensor mechanism as defined in claim 15 wherein said spring layer of said damping assembly biases said sealing layer toward said first surface throughout said first amount of movement of said mass.

18. A sensor mechanism as defined in claim 15 wherein said first surface on said base defines a cavity having an opening, said first surface having a portion extending around said opening, said second surface on said sealing layer being in contact with said portion of said first surface and being flexed inwardly of said opening to define said space within said cavity when said damping assembly is in said initial position.

19. A sensor mechanism as defined in claim 15 wherein said sensing means comprises means for defining an electrical current path along which electric current flows in response to a predetermined amount of movement of said mass relative to said base.

20. A sensor mechanism as defined in claim 15 wherein said sealing layer and said spring layer are disk-shaped.

21. A sensor mechanism as defined in claim 15 wherein said damping assembly further comprises a rigid damping member, said second surface on said sealing layer being in overlying contact with said rigid damping member when said damping assembly is in said open position.

22. A sensor mechanism as defined in claim 21 wherein said second surface on said sealing layer is in overlying contact with said rigid damping member during said first amount of movement of said mass, such overlying surface contact increasing during said first amount of movement of said mass.

23. A gas damped sensor mechanism comprising:

a base having a first surface;

a mass;

means for supporting said mass for movement relative to said base;

means for sensing a predetermined amount of movement of said mass relative to said base;

a movable flexible damping assembly having a second surface, said flexible damping assembly having an initial position wherein said second surface is engaged with said first surface to define a space having an initial volume between said base and said flexible damping assembly;

said flexible damping assembly being connected to said mass to move from said initial position to enlarge the volume of said space and to cause a pressure reduction in said space in response to movement of said mass relative to said base, said pressure reduction restraining movement of said mass relative to said base; and said flexible damping assembly comprising a flexible sealing member having said second surface, and a flexible spring member which biases said flexible sealing member toward said first surface when said flexible damping assembly is in said initial position.

24. A sensor mechanism as defined in claim 23 wherein said flexible sealing member and said flexible spring member are disks.

25. A sensor mechanism as defined in claim 23 wherein said flexible sealing member is located between said flexible spring member and said base.

26. A sensor mechanism as defined in claim 23 wherein said mass has an axis and is movable in a direction along said axis relative to said base, said flexible sealing member comprising a pair of overlying disk-shaped parts coaxially connected to said mass.

27. A sensor mechanism as defined in claim 26 wherein each of said overlying disk-shaped parts has radially extending slots defining circumferentially spaced segments of such part, the slots of one part being offset circumferentially from the slots of the other part.

28. A sensor mechanism as defined in claim 27 wherein said flexible spring member is disk-shaped and is coaxially connected to said mass in a position to overlie said flexible sealing member.

29. A sensor mechanism as defined in claim 28 wherein said flexible spring member has radially extending slots defining circumferentially spaced segments of said flexible spring member.

30. A sensor mechanism as defined in claim 29 further comprising a rigid disk coaxially connected to said mass, said flexible sealing member having a diameter greater than the diameter of said rigid disk and having a position in overlying surface contact with said rigid disk.

31. A sensor mechanism as defined in claim 23 wherein said mass has an axis, said flexible spring member is a disk coaxially connected to said mass, said flexible sealing member is a disk coaxially connected to said mass between said flexible spring member and said base, said sensor mechanism further comprising a rigid disk coaxially connected to said mass between said flexible sealing member and said base.

32. A sensor mechanism as defined in claim 31 wherein said rigid disk has a diameter less than the diameter of said flexible sealing member, and further comprising means for holding said flexible sealing member in a flexed condition throughout movement of said mass relative to said base.

33. A sensor mechanism as defined in claim 32 wherein said holding means comprises an axially projecting surface portion of said flexible sealing member.

34. A sensor mechanism as defined in claim 32 wherein said holding means comprises an axially projecting surface portion of said rigid disk.

35. A sensor mechanism as defined in claim 23 wherein said sensing means comprises means for defining an electrical current path along which electric current flows in response to said predetermined amount of movement of said mass.

36. A gas damped sensor mechanism comprising:

a base having a first surface;

a mass;

means for supporting said mass for movement relative to said base;

means for sensing a predetermined amount of movement of said mass relative to said base;

a flexible sealing member having a second surface which sealingly engages said first surface to block the flow of damping gas past said flexible sealing member between said surfaces;

said flexible sealing member being connected to said mass to move said second surface out of engagement with said first surface upon movement of said mass relative to said base; and said flexible sealing member comprising a pair of sealing elements, each of said sealing elements having at least one slot defining spaced apart segments of such sealing element, said sealing elements being in overlying contact with each other with the slots of one sealing element offset from the slots of the other sealing element.

37. A sensor mechanism as defined in claim 36 wherein said sealing elements are coaxial disks in overlying contact with each other.

38. A sensor mechanism as defined in claim 37 wherein said slots extend radially, said segments being spaced apart circumferentially by said slots.

39. A sensor mechanism as defined in claim 38 wherein said sealing elements have equal diameters.

40. A sensor mechanism as defined in claim 37 further comprising a spring member having a position in overlying contact with said flexible sealing member to bias said second surface into engagement with said first surface.

41. A sensor mechanism as defined in claim 40 wherein said sealing elements and said spring member are coaxial disks.

42. A sensor mechanism as defined in claim 36 wherein said sensing means comprises means for defining an electrical current path along which electric current flows in response to a predetermined amount of movement of said mass relative to said base.

43. A gas damped deceleration sensor comprising:

a base having a first surface defining a cavity with an opening, said first surface having a portion extending around said opening;

a mass;

means for supporting said mass for inertial movement relative to said base in response to deceleration of said base;

means for sensing a predetermined amount of movement of said mass relative to said base;

a movable, flexible damping member having a second surface facing said first surface, having an initial position wherein said second surface contacts said portion of said first surface to define a space within said cavity between said base and said damping member, said damping member being flexed inwardly of aid opening when in said initial position, and having an open position wherein said second surface does not contact said first surface;

said damping member being connected to said mass to move with said mass relative to said base, said damping member flexing outwardly relative to said opening to enlarge said space and to cause a pressure reduction within said space in response to a first amount of said movement of said mass, and moving away from said first surface into said open position in response to a second amount of said movement of said mass, said pressure reduction restraining movement of said mass relative to said base.

44. A sensor as defined in claim 43 further comprising a flexible spring member contacting said damping member to bias said damping member against said portion of said first surface during said first amount of movement of said mass.

45. A sensor as defined in claim 43 further comprising a rigid damping member connected to said mass, said flexible damping member flexing into increasing surface contact with said rigid damping member when flexing outwardly relative to said opening.

46. A sensor as defined in claim 43 wherein said sensing means comprises means for defining an electrical current path along which electric current flows in response to a predetermined amount of movement of said mass relative to said base.

47. An assembly for damping movement of a mass that moves inertially in a gas damped deceleration sensor in response to deceleration of the sensor, said assembly comprising:

a rigid damping member;

a flexible damping member; and means for connecting said damping members to the mass for said damping members to move with the mass when the mass moves inertially in the deceleration switch, and for said flexible damping member to be flexible into overlying surface contact with said rigid damping member during such movement.

48. An assembly as defined in claim 47 wherein said rigid damping member is a disk having a first diameter, said flexible damping member being a disk coaxial with said rigid damping member and having a second diameter greater than said first diameter.

49. An assembly as defined in claim 48 wherein said flexible damping member comprises a flexible sealing layer and a flexible spring layer, said flexible spring layer being in overlying surface contact with said flexible sealing layer to resist flexing movement of said flexible sealing layer out of contact with said rigid damping member.

50. An assembly defined in claim 49 wherein said flexible sealing layer comprises a pair of overlying disk-shaped elements, said elements having a common axis and slots extending radially from said axis to define spaced-apart segments of said elements, the slots of each element being offset from the slots of other element so that said segments block the flow of damping gas through said flexible sealing layer.

51. An assembly as defined in claim 49 wherein said flexible spring layer and said flexible sealing layer have equal diameters.

52. An assembly as defined in claim 47 wherein said damping members are coaxial disks, said connecting means comprising coaxial openings through said damping members.

* * * * *

UNITED STATES PATENT AND TRADEMARK OFFICE

CERTIFICATE OF CORRECTION

PATENT NO. : 5,066,837

DATED : November 19, 1991

INVENTOR(S) : Kevin J. Gunning, et al.

It is certified that error appears in the above-identified patent and that said Letters Patent is hereby corrected as shown below:

column 13, line 11, claim 14, change "1" to --2--.

column 15, line 56, claim 40, change "37" to --36--.

column 16, line 17, claim 43, change "aid" to --said--.

Signed and Sealed this

Twenty-third Day of March, 1993

*Attest:*

STEPHEN G. KUNIN

*Attesting Officer*

*Acting Commissioner of Patents and Trademarks*